United States Patent [19]

Graham et al.

[11] Patent Number: 4,670,919

[45] Date of Patent: Jun. 9, 1987

[54] STRESS REDUCTION AND HYPOVOLEMIC SHOCK PREVENTION SPA

[75] Inventors: Ralph E. Graham, Santa Ana; Tyler T. Zambory, Anaheim, both of Calif.

[73] Assignee: Vigorobics Invigorating Machine, Inc., Orange, Calif.

[21] Appl. No.: 796,568

[22] Filed: Nov. 8, 1985

[51] Int. Cl.[4] ..... E03C 1/02; A61H 33/02

[52] U.S. Cl. ..... 4/541; 4/542; 4/543; 4/559; 128/66

[58] Field of Search ..... 4/541, 542, 492, 488, 4/490, 559; 128/66; 239/428.5, 587, 261, 273, 279, 289

[56] References Cited

U.S. PATENT DOCUMENTS

| | | | |
|---|---|---|---|
| 3,905,358 | 9/1975 | Jacuzzi | 128/66 |
| 4,082,091 | 4/1978 | Raab | 128/66 |
| 4,090,507 | 5/1978 | Van Horn | 128/66 |
| 4,099,552 | 7/1978 | Alenares | 128/66 |
| 4,261,347 | 4/1981 | Spencer, III et al. | 4/559 |
| 4,339,833 | 7/1982 | Mandell | 4/542 |
| 4,466,141 | 8/1984 | Starkey | 4/488 |
| 4,523,340 | 6/1985 | Watkins | 128/66 |

*Primary Examiner*—Henry K. Artis

*Attorney, Agent, or Firm*—Price, Gess & Ubell

[57] ABSTRACT

An apparatus and method for preventing hypovolemic shock to a human body. While the human body is in a sitting position, venturi jets fixed to one another emit pressurized water to contact the frontal and rear areas of the lower extremities and backside of the upper torso. The venturi jets are vertically displaced along the contours of the lower extremities and backside as the water from the venturi jets continually contact the lower extremities and backside at generally perpendicular angles thereto.

14 Claims, 5 Drawing Figures

STRESS REDUCTION AND HYPOVOLEMIC SHOCK PREVENTION SPA

BACKGROUND OF INVENTION

1. Field of the Invention

This invention relates generally to the field of hydrotherapy apparatus and methods, and specifically to an apparatus and method for preventing hypovolemic shock to a human body as a result of being immersed in hot water.

2. Brief Description of the Prior Art

The use of spas and pools that circulate heated water to provide hydrotherapy or general relaxation to the human body has increased over the past years. One of the earlier designs is shown in Van Horn, "Hydrotherapy Tank," U.S. Pat. No. 4,090,507. Van Horn describes an apparatus that spirals water solely around the lower portions of the lower extremities of the human body. The lower extremities are required to be in an elevated position. Similarly, Alenares. "Hydrotherapy Apparatus and Method for Exercising the Veins of the Leg and Foot," U.S. Pat. No. 4,099,522 shows apparatus that directs water specifically to the feet and calf portions of the lower extremities while the lower extremities remain horizontal in a collecting pan.

More recently, Mandell, "Reciprocating Hydro-Message Apparatus,38 U.S. Pat. No. 4,339,833 suggests use of a tub suitable for a human body to be seated therein and almost completely submerged in water. An apparatus is provided for reciprocating nozzles that emit water solely to the backside of the upper torso. In a somewhat similar fashion, Starkey, "Hydrothermal Treatment Facility," U.S. Pat. No. 4,466,141 depicts a vessel in which a human body can be supported in various positions while almost completely submerged in water. Jets emit water to contact the various joints of the body.

One problem encountered by persons who use spas and pools, particularly like those shown in Mandell and Starkey, is that increased body heat is produced which, in turn, may result in hypovolemic shock. The circulatory system in the human body attempts to correct the increase in body heat by dilating the superficial arteries and veins of the skin. The flushing of blood to the skin necessarily drains blood away from the large central arteries and veins of the circulatory system.

In normal activities, the muscle and skeletal systems assist in pumping the blood back towards the heart. However, in the hot water of a spa or pool where there is little or no physical activity by the human hody, the combination of inactivity and flushing of blood to the surface of the skin removes a large volume of blood from the central circulatory system. This could result in the heart contracting on an empty chamber. Should this occur, blood pressure will drop precipitously, the human body may become suddenly weak and lapse into unconsciousness or suffer a heart attack.

SUMMARY OF THE INVENTION

An object of the present invention is to provide an improved apparatus and a method to counteract hypovolemic shock that might otherwise develop in a human body submerged in hot water for an extended period of time.

Another object of the present invention is to provide an improved apparatus to give general relaxation to the human body while promoting the return of the venous blood in the lower extremities towards the heart to prevent the pooling of blood in the lower extremities and counteract hypovolemic shock.

A further object of the invention is to provide an apparatus which accomplishes the aforementioned objects and can be utilized in a pool or spa.

These and other objects of the invention are particularly accomplished by directing pressurized water continually against the lower extremities and backside of the upper torso in an unidirectional sequential motion beginning from the lower portions of the lower extremities and backside up to their respective uppe portions. The pressurized water is directed at such body surfaces at angles generally perpendicular thereto.

DETAILED DESCRIPTION OF THE PREFERRED EMBODIMENT

Figure 1:
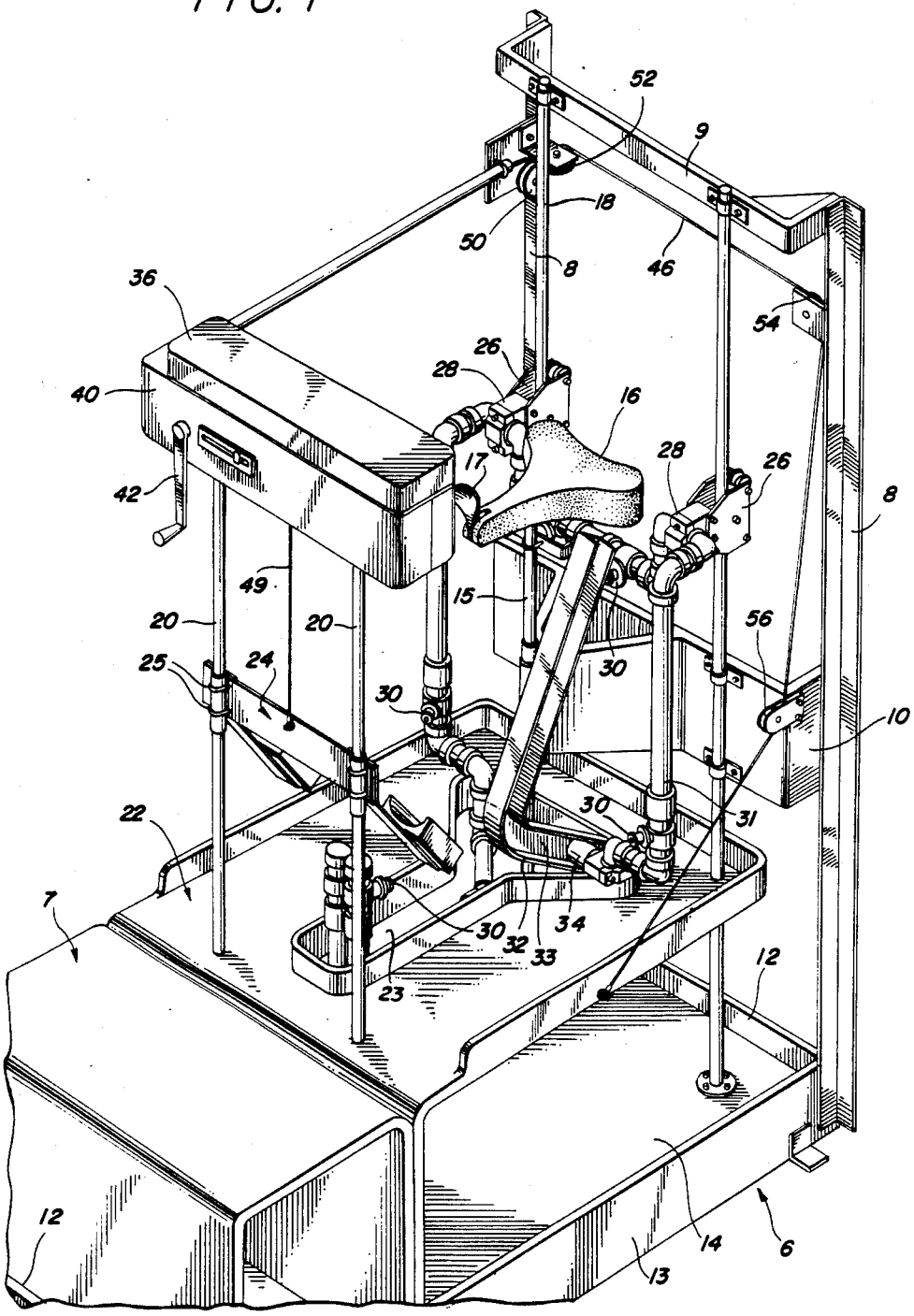
FIG. 1 is a perspective view of the preferred structure present invention for directing pressurized water to various parts of the body.

In FIG. 1, a frame 6, suitable for immersion in a pool or spa, is provided for supporting various parts of the invention. Frame 6 has a generally "L"-shaped configuration, with one side defining a first horizontal plane and the other a first vertical plane. That part of frame 6 which defines the first vertical plane includes a pair of vertical supports 8 disposed parallel to one another in the first vertical plane. Each vertical support 8 is an elongated, rigid element. That portion of frame 6 which defines the first vertical plane further includes a first horizontal support 9 rigidly fixed to and disposed between the uppermost ends of the pair of vertical supports 8. A second horizontal support 10 similarly lies in the first vertical plane and is rigidly fixed to and disposed between the pair of vertical supports 8 near the middle portion of the first vertical plane.

That portion of frame 6 which defines the first horizontal plane includes a base 14 which is a rectangular shaped, planar element having one of its shorter edges positioned at the intersection of the first horizontal and first vertical planes. Such portion of frame 6 further includes a pair of legs 13 positioned along the two longer edges of base 14. Each leg 13 is a generally elongated, rigid element having one end fixed to the respective ends of vertical supports 8 which are in the lowermost portion of the first vertical plane. Also in the first horizontal plane is a pair of third horizontal supports 12, each being generally elongated, rigid elements positioned along the two shorter edges of base 14. The third horizontal support 12 disposed nearest the intersection of the first horizontal plane and first vertical plane is rigidly fixed to and positioned between the pair of legs 13.

Frame 6 further includes a lateral support 7 which is positioned at that end of base 14 which is opposite the intersection of the first horizontal and first vertical planes. Lateral support 7 is a generally "U"-shaped element, the extended ends of which are directed towards base 14, with one end being positioned near the shorter end of base 14 furthest from the intersection of the first vertical and first horizontal planes and the other end being closer to such intersection. Lateral support 7 has a surface area whose width is sufficient to extend the distance measured by the shorter ends of base 14.

Figure 2:
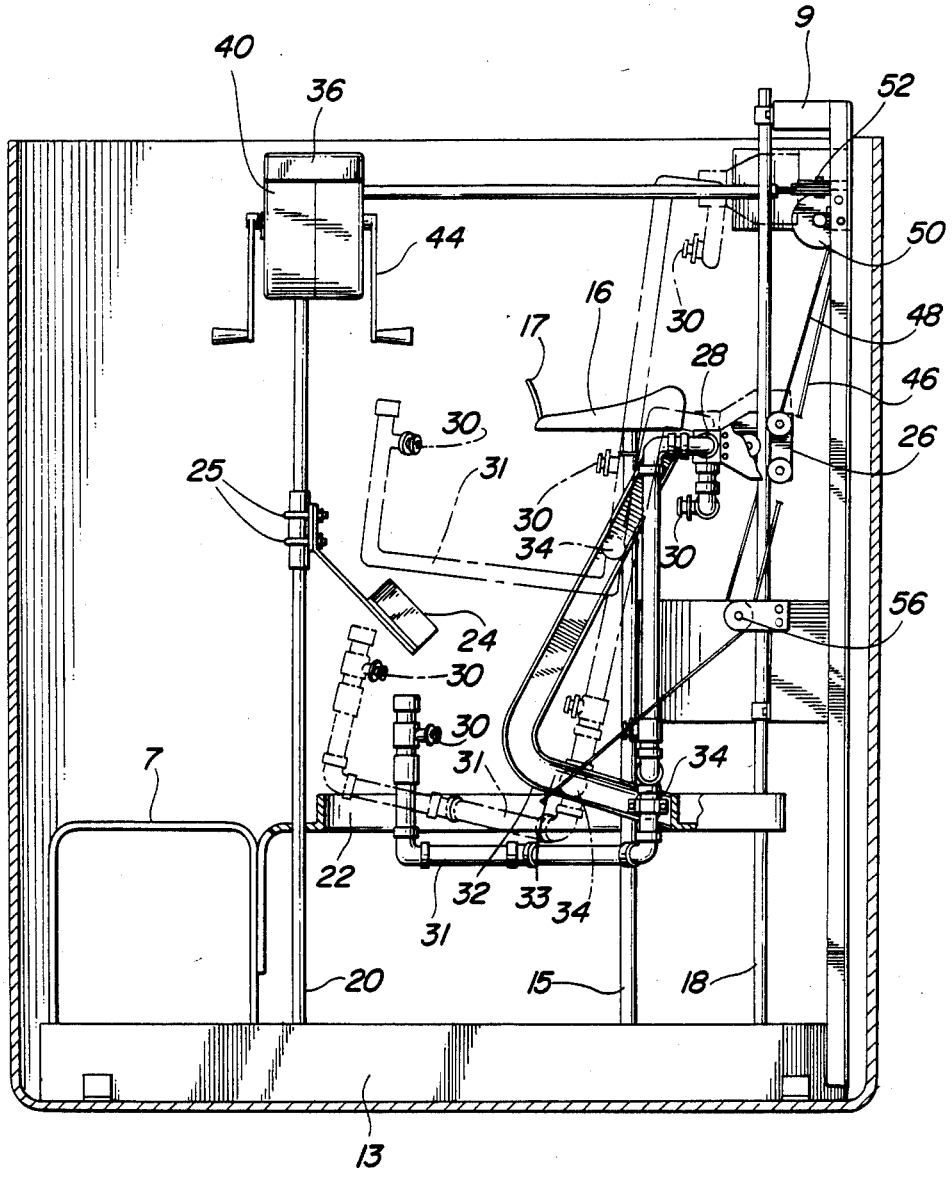
FIG. 2 is a side, elevation view of the invention shown in FIG. 1 and further depicting various positions of the venturi jets.

Still referring to FIG. 1 and also FIG. 2, a seat pole 15, which is an elongated, rod-shaped element, is disposed perpendicular to and stationarily fixed to base 14. Seat pole 15 is supported laterally by being connected to second horizontal support 10. Disposed on the uppermost end of seat pole 15 is a seat 16 which is a planar, triangular shaped element having its exterior sides concave towards the center thereof, somewhat like a bicycle seat, and thereby defining three apexes. The planar surface of seat 16 is generally perpendicular to the longitudinal axis of seat pole 15. Further, two of the apexes of seat 16 are disposed at points generally equidistant from the first vertical plane. On the apex opposite such two apexes is a protective element 17 being a flat element having part of its edge rounded and the opposite edge tapered. Such tapered end of protective element 17, is rotatably connected to seat 16 to allow rotation about an axis perpendicular to the longitudinal axis of seat pole 15 which, when so rotated, protects the gonadal area of the human body seated on seat 16 from pressurized water, as will be evident from the description below.

A pair of rear poles 18, each being elongated, rod shaped elements and of a length greater than seat pole 15 are disposed parallel to one another, parallel to the first vertical plane, and positioned in the area between seat pole 15 and the first vertical plane. One end of each rear pole 18 is stationarily fixed to base 14 while the opposite end is stationarily fixed to first horizontal support 9. The points at which each rear pole 18 is fixed to base 14 are near the two intersections of legs 18, vertical supports 8 and third horizontal support 12. The points at which the uppermost ends of each rear pole 18 are fixed to first horizontal support 9 are near the two intersections of first horizontal support 9 with vertical supports 8.

In FIG. 1, a pair of front poles 20, each being elongated, rod-shaped elements of a length less than rear poles 18 and greater than seat pole 15, are parallel to each other and parallel to the first vertical plane, with the lowermost end of each front pole 20 being stationarily fixed to base 14. Front poles 20 are positioned at a distance measured from the intersection of the first horizontal and first vertical planes which is greater than that distance measured by seat pole 15 from such intersection. A leg support 24 is slidably connected to front poles 20 along their longitudinal axes by two pairs of second slidable connectors 25, one pair being associated with each front pole 20. Leg support 24 is moved by activation of a second pulley handle 44 and a third pulley line 49, described below. Leg support 24 is a three sided element having two of its sides perpendicular to the third, such two sides being angularly disposed from front poles 20 and towards the first horizontal plane. Such two sides of leg support 24 are recessed and dimensioned to receive a part of the frontal area of the legs of a human body below the knees.

On the uppermost ends of front poles 20 is a pulley housing 40 that encloses a pulley mechanism of any conventional design to operate two pulley systems described below. On the uppermost surface of pulley housing 40 is an arm and head support 36, being a flat element on which the forearms and head can be rested while the human body is seated on seat 16.

As better shown in FIG. 1, a foot support 22 to support a person's feet is a generally planar element disposed in a second horizontal plane which is parallel to and above the first horizontal plane. The planar portion of foot support 22 further defines an aperture 23 therein which is generally "Y"-shaped. With the exception of that edge farthest removed from the first vertical plane, the edges of foot support 22 are turned up above the second horizontal plane. Foot support 22 is slidably connected to front poles 20 and rear poles 18 to slide along the longitudinal axes of them and thereby be adjusted to the legs of different persons.

Foot support 22 moves along the longitudinal axes of front poles 20 and rear poles 18 by activation of a pulley system in the preferred embodiment. However, other means to effect similar movement would be suitable. In the preferred embodiment, a first pulley handle 42 is rotatably connected to any conventional pulley mechanism in pulley housing 40 to activate a first pulley line 46 having one end connected to such conventional pulley mechanism. First pulley line 46 runs from pulley housing 40 through pulley 52 which is supported by one of the two vertical supports 8, then through pulley 54 which is supported by the other vertical support 8, down to pulley 56 which is supported by second horizontal support 10, and finally connected to foot support 22 on one edge thereof which is generally parallel to leg 13. Also activated by first pulley handle 42 is a second pulley line 48 which runs from pulley housing 40 through pulley 60 and connected to foot support 22 on the edge thereof which is opposite the edge connected to first pulley line 46. Likewise, second pulley handle 44 is rotatably connected to the conventional pulley mechanism to activate third pulley line 49 and thereby leg support 24.

Refering to FIG. 1, a jet pipe 31 is rotatably and slidably connected to rear poles 18 by a pair of rotatable connectors 28 and a pair of first slidable connectors 26, respectively. Each rotatable connector 28 allows jet pipe 31 to rotate about an axis generally perpendicular to rear poles 18. Each first slidable connector 28 permits jet pipe 31 to slide along the longitudinal axes of rear poles 18. Rotatable connectors 28 and first slidable connectors 26 can be of any conventional means.

Figure 4:
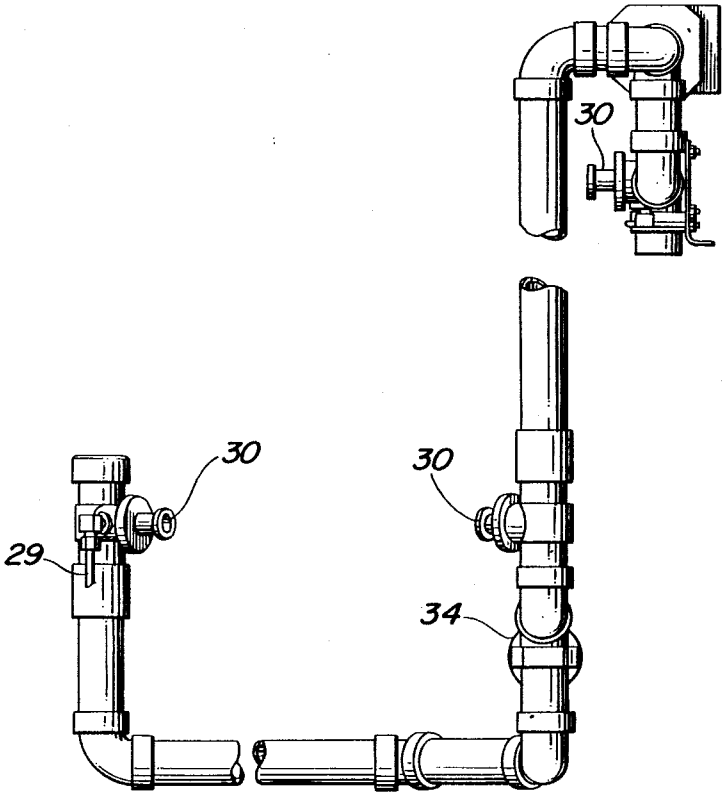
FIG. 4 is a side, elevation view of FIG. 3.
Figure 3:
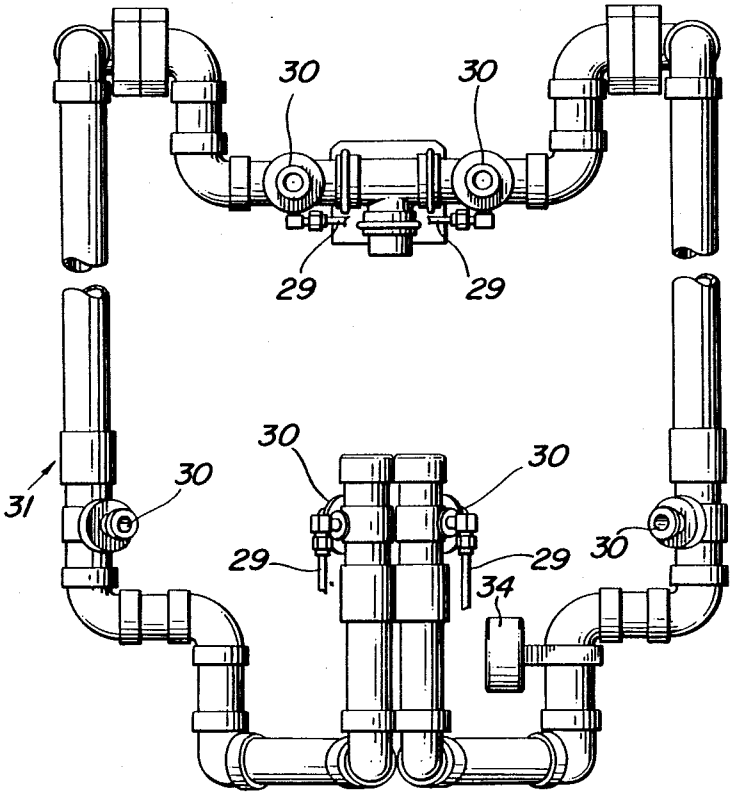
FIG. 3 is a front, elevation view of the jet pipe having venturi jets connected thereto, the scale being larger than FIGS. 1 and 2.

As shown in FIGS. 3 and 4, jet pipe 31 is a pipe partially disposed in a rectangular shape that defines a second vertical plane disposed near the backside of the human body seated on seat 16. The two ends of jet pipe 31 extend out perpendicularly from the second vertical plane and towards front poles 20, which extension is from the lowest side of the defined rectangle in the second vertical plane. The extended portion of jet pipe 31 is disposed in an "L"-shaped configuration such that the ends of jet pipe 31 define the shorter side of the configuration. The ends are disposed in the area in front of the lower extremities of the human body seated on seat 16. The longer side of the "L"-shaped configuration of jet pipe 31 is positioned in aperture 23 of foot support 22.

Still referring to FIGS. 3 and 4, a venturi jet 30 is connected to each end of jet pipe 31 for emission of pressurized water towards the frontal area of the lower extremities. A venturi jet 30 is also connected to each of the lower corners in the rectangular shaped portion of jet pipe 31 for emission of pressurized water towards the rear area of the lower extremities. A pair of venturi jets 30 are also connected to jet pipe 31 on the top side of the rectangular shaped portion of jet pipe 31 for emission of pressurized water towards the backside of the upper torso.

Each venturi jet 30 is a tube-shaped element having a circular cross section in the middle portion thereof smaller than the two ends which diverge away from the middle portion. The surface area of the middle portion of venturi jet 30 defines a plurality of apertures. Air supply means (not shown) is connected to an air inlet 29 on venturi jet 30 which is in communication with the apertures. This provides a means for uniformly supplying air to the water stream moving through venturi jet 30.

Jet pipe 31 and venturi jets 30 are vertically displaced by activation of a hyraulic system 61, further described below. A guide 32 and a roller 34 is further provided to guide venturi jets 30 in a vertical course along the contours of the lower extremities and backside of the upper torso. Guide 32 is a generally elongated, three-sided element in an "L"-shaped configuration whose sides define a recess 33 along its longitudinal axis. Guide 32 is fixed to seat pole 15. Roller 34 is connected to jet pipe 31 at one of its lowermost corners in the defined rectangular shape. Roller 34 is configured and dimensioned to be received by recess 33. In the preferred embodiment, only one guide 32 is utilized. However, a pair of guides 32 being disposed on either side of seat pole 15 is contemplated.

Figure 5:
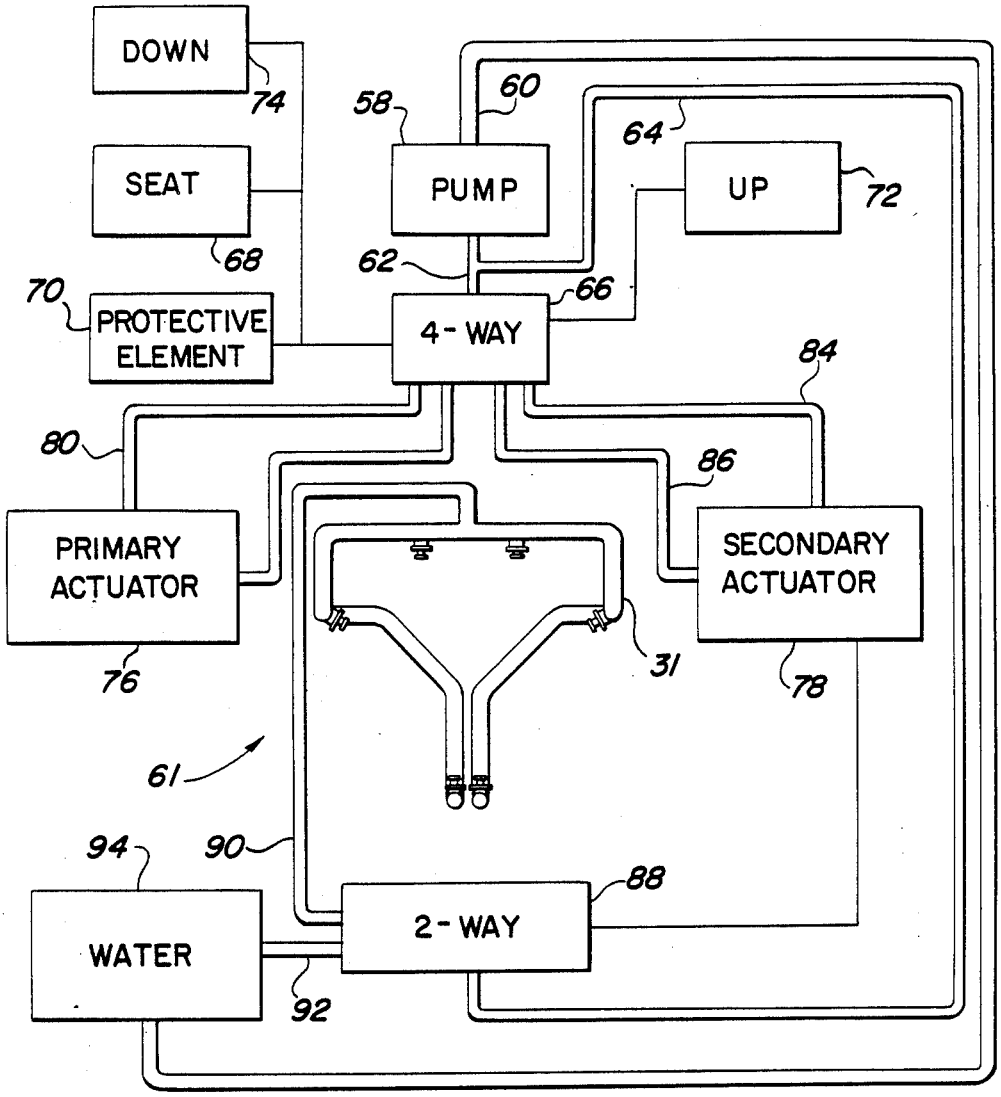
FIG. 5 is a depiction of the hydraulic system that is connected to the jet pipe.

Hydraulic system 61 is provided to control the emission of pressurized water from venturi jets 30, as well as vertically displace jet pipe 31. In FIG. 5, an inlet pipe 60 is connected to a water source 94 and a pump 58 which draws water from water source 94 and pumps such water through hydraulic system 61. Water source 94, in the preferred embodiment, is the spa or pool containing water. A first pipe 62 is intermediate pump 58 and a 4-way valve 66. In the preferred embodiment, first pipe 62 is a $\frac{3}{8}$" PVC pipe and 4-way valve 66 is manufactured by Comp Air. Connected in series to 4-way valve 66 is a seat switch 68, a protective element switch 70 and a down swiich 74. Seat switch 68 is activated upon the human body being seated on seat 16. Protective element 70 is activated by protective element 17 being rotated to a position above seat 16. Down switch 74 is activated by jet pipe 31 being disposed below the highest point it can reach in its vertical traverse. An up switch 72 is also connected to 4-way valve 66 and is activated by jet pipe 31 being at its highest point in its vertical traverse. Seat switch 68, protective element switch 70, up switch 72, and down switch 74 are, in the preferred embodiment, limit switches manufactured by Koganei.

A primary actuator 76, which activates jet pipe 31, is connected to 4-way valve 66 by a third pipe 80 and a fourth pipe 82. In the preferred embodiment, primary actuator 76 is a hydraulic actuator manufactured by Joucomatic. A second actuator 78 is also connected to 4-way valve 66 by a fifth pipe 84 and a sixth pipe 86. Secondary acutator 78 is a hydraulic actuator having a stroke shorter than primary acutator 76. A 2-way valve 88 which, in the preferred embodiment is a Mark-Urban valve, is actuated by secondary actuator 78. 2-way valve 88 is connected to pump 58 by a second pipe 64 and also connected to jet pipe 31 by a seventh pipe 90. Leaving 2-way valve 88 is an eighth pipe 92 which leads back to water source 94. In the preferred embodiment, second pipe 64 is a $1\frac{1}{4}$" PVC pipe.

Having described the various elements in the present invention, the following describes the operation of those elements.

While a human body is seated on seat 18, foot support 22 is vertically adjusted by rotating first pulley handle 42 which changes the effective lengths of first pulley line 46 and second pulley line 48. Leg support 24 is adjusted by rotating second pulley handle 44 which changes the effective length of third pulley line 49. Seat switch 68 is activated by the pressure on seat 16. Protective element 17 is rotated above seat 16 to activate protective element switch 70. With jet pipe 31 below the highest point it can reach in its vertical traverse, down switch 74 is activated. With seat switch 68, protective element switch 70 and down switch 74 activated, pump 58 pumps water from water source 94 through inlet pipe 60, out first pipe 62 and into 4-way valve 66. Water then flows into primary actuator 76 from fourth pipe 82 and displaced out of primary actuator 76 through third pipe 80. Primary actuator 76 thereby causes jet pipe 31 to move upwardly. Referring to FIG. 2, jet pipe 31 is in its lowermost position. As primary actuator 76 moves jet pipe 31 upwardly along the longitudinal axes of rear poles 18 through first slidable connectors 26, roller 34 rotates and slides within recess 33 of guide 32. Rotatable connectors 28 allow jet pipe 31 to rotate as a result of the upward movement of jet pipe 31 in the particular "L"-shaped configuration of recess 33. At the same time, water is flowing into secondary actuator 78 from fifth pipe 84 and displaced out of secondary actuator 78 through sixth pipe 86 such that secondary actuator 78 causes 2-way valve 88 to receive water through second pipe 64 and direct the water into seventh pipe 90. Seventh pipe 90 leads into jet pipe 31 to provide an emission of pressurized water through venturi jets 30.

As long as the human body remains seated on seat 16, protective element 17 is rotated above seat 16, and jet pipe 31 is below its highest point in the vertical traverse, pressurized water will continue to be admitted through venturi jets 30. Such pressurized water will contact simultaneously the frontal and rear areas of the lower extremities as well as contacting the backside of the upper torso. The contact of water on the lower extremities and backside is generally at angles perpendicular to the surfaces contacted.

Once jet pipe 31 reaches its highest point in the vertical traverse, up switch 72 becomes activated. 4-way valve 66 will then cause water to flow into primary actuator 76 from third pipe 80 and exit through fourth pipe 82 bringing jet pipe 31 down. Water will at the same time be entering secondary actuator 78 through sixth pipe 86 and exiting from fifth pipe 84 to cause 2-way valve 88 to direct the water flow out through eighth pipe 92 and into water source 94. Thereby no pressurized water is emitted from venturi jets 30 during the down movement of jet pipe 31.

It should be understood, of course, that the forgoing relates to a preferred embodiment of the invention and that modifications may be made without departing from the spirit and scope of the invention as set forth in the following claims.

I claim:

1. An apparatus for preventing hypovolemic shock to a human body, comprising:

support means for supporting and positioning the human body in a pool of water so that the lower extremities remain in a stationary position;

emission means for emitting pressurized water to contact the lower extremities, the emission means including a plurality of venturi jets, some which are moveably disposed near opposing frontal and rear areas of the lower extremities; and directional means for continually directing the pressurized water at opposing frontal and rear areas of the lower extremities, the water only being emitted in a sequence from the lower portions of the lower extremities to their respective upper portions and thereby providing an upwardly moving constricting force on the lower extremeties, the directional means including a jet pipe for connecting the venturi jets to one another, means for traversing the jet pipe in a generally vertical course that follows the contours of the lower extremities, and a guide connected to the jet pipe for guiding the travel of the venturi jets in the vertical course.

2. The invention of claim 1 further comprising regulating means for controlling the emission means to emit water only during the directional sequence from the lower portions to the upper portions of the lower extremities.

3. The invention of claim 1 wherein the pressurized water is continually directed at angles generally perpendicular to the longitudinal axes of the lower extremities.

4. The invention of claim 1 wherein the emission means emit pressurized water to contact the backside of the upper torso of the human body.

5. The invention of claim 4 wherein the directional means directs the pressurized water angularly to the backside of the upper torso in a sequence beginning from the lower portion of the backside to its upper portion.

6. The invention of claim 1 wherein the support means comprises:

a frame;

a seat supported by the frame;

a leg support supported by the frame; and a foot support disposed below the seat and supported by the frame.

7. The invention of claim 1 wherein at least one venturi jet is moveably disposed near the backside of the upper torso of the human body.

8. The invention of claim 1 wherein at least two venturi jets are disposed near the frontal areas of the lower extremities and at least two venturi jets are disposed near the rear areas of the lower extremities.

9. An apparatus for preventing hypovolemic shock to a human body, comprising:

a frame positioned in a horizontal plane;

a seat support pole connected to the frame;

a set supported by the seat support pole to permit the lower extremities of the human body to extend towards the horizontal plane;

a plurality of rear support poles connected to the frame, each rear support pole being disposed in back of the human body seated on the seat;

a plurality of front support poles connected to the frame, each front support pole being disposed in front of the human body seated on the seat;

a foot support slidably connected to the front support poles and rear support poles to permit the foot support to move along the longitudinal axes of such poles, the foot support being disposed below the seat for supporting the feet of the human body;

a leg support slidably connected to the front support poles to permit the leg support to move along the longitudinal axes of the front support poles, the leg support being disposed between the front support poles and the human body seated on the seat;

a first activating means for moving the foot support;

a second activating means for moving the leg support;

a plurality of venturi jets that emit water therefrom; and means for moving the venturi jets in a generally vertical course that follows the contours of the lower extremities of the human body.

10. The invention of claim 9 wherein the seat is configured and dimensioned to minmize the area of the lower extremities covered by the seat.

11. The invention of claim 9 wherein the means for moving the venturi jets comprises:

a jet pipe which connects the venturi jets to one another;

means for traversing the jet pipe in the vertical course; and a guide connected to the jet pipe for guiding the travel of the venturi jets in the vertical course.

12. The invention of claim 9 further comprising regulating means for controlling the venturi jets to emit water only when the venturi jets are travelling in an upwardly direction in the vertical course.

13. The invention of claim 12 wherein the regulating means comprises a hydraulic system.

14. The invention of claim 13 wherein the hydraulic system comprises:

a pump;

a first pipe connected to the pump;

a second pipe connected to the pump;

a four-way value connected to the first pipe;

two switches in series with one another and connected to the four-way valve, the first switch being activated by the human body on the seat, and the second by the venturi jets being disposed below the highest point they reach in the vertical course;

a third switch connected to the four-way value and being activated by the venturi jets being disposed at the highest point they reach in the vertical course;

a third pipe connected to the four-way valve;

a fourth pipe connected to the four-way valve;

a fifth pipe connected to the four-way valve;

a sixth pipe connected to the four-way valve;

a first hydraulic actuator connected to the third and fourth pipes;

a second hydraulic actuator connected to the fifth and sixth pipes;

a two-way valve activated by the second hydraulic actuator and connected to the second pipe;

a seventh pipe connected between the two-way valve and jet pipe whereby activation of the first and second switches causes an emission of water from the venturi jets, and activation of the third switch prevents an emission of water.

15. An apparatus for emitting a pressurized, aerated water stream, comprising:

a tube having a circular cross section that defines a water flow passage, one part having a smaller cross section than the ends which diverge away from such smaller cross section, and thereby having a larger cross section, with that part of the tube having both smallest cross section defining a plurality of apertures throughout such part; and air supply means externally about the tube for providing air to the plurality of apertures whereby the water passing by the plurality of apertures entrain the air to form a pressurized, aerated water stream.

* * * * *